US012123119B1

(12) United States Patent
Martelli

(10) Patent No.: US 12,123,119 B1
(45) Date of Patent: Oct. 22, 2024

(54) INDEPENDENT THREAD TENSION APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 43 days.

(21) Appl. No.: 18/106,547

(22) Filed: Feb. 7, 2023

Related U.S. Application Data

(60) Provisional application No. 63/307,667, filed on Feb. 8, 2022.

(51) Int. Cl.
*D05B 47/04* (2006.01)
*D05B 51/00* (2006.01)

(52) U.S. Cl.
CPC ..... *D05B 47/04* (2013.01); *D05B 51/00* (2013.01); *D05D 2205/32* (2013.01)

(58) Field of Classification Search
CPC ..... D05B 47/04; D05B 47/02; D05B 47/00; D05B 51/10; D05B 43/00; D05B 45/00; D05B 51/00; D05D 2205/32; D05D 2205/00
See application file for complete search history.

(56) References Cited

U.S. PATENT DOCUMENTS

| | | | | |
|---|---|---|---|---|
| 3,381,641 | A * | 5/1968 | Bialy | D05B 43/00 223/107 |
| 4,215,641 | A * | 8/1980 | Dobrjanskyj | D05B 49/02 112/278 |
| 4,579,615 | A * | 4/1986 | Hanyu | D05C 11/16 156/509 |
| 4,825,786 | A * | 5/1989 | Burch | D05B 51/00 112/181 |
| 5,404,824 | A * | 4/1995 | Hiraoka | D05B 65/00 112/300 |
| 7,114,455 | B2 * | 10/2006 | Prufer | D05B 43/00 112/258 |
| 7,513,203 | B2 * | 4/2009 | Eklund | D05B 49/00 112/475.17 |
| 2010/0242819 | A1 * | 9/2010 | Fukao | D05C 3/02 112/80.7 |

* cited by examiner

*Primary Examiner* — Ismael Izaguirre
(74) *Attorney, Agent, or Firm* — J. Nevin Shaffer, Jr.

(57) ABSTRACT

An independent thread tension apparatus and method has a thread support where the thread support releasably retains thread. A motor is connected with the thread support and a controller is connected with the motor such that the controller operates to move the thread support in a first direction as thread is pulled off the thread support in a second direction opposite to the first direction such that a selected tension is added to the thread.

20 Claims, 1 Drawing Sheet

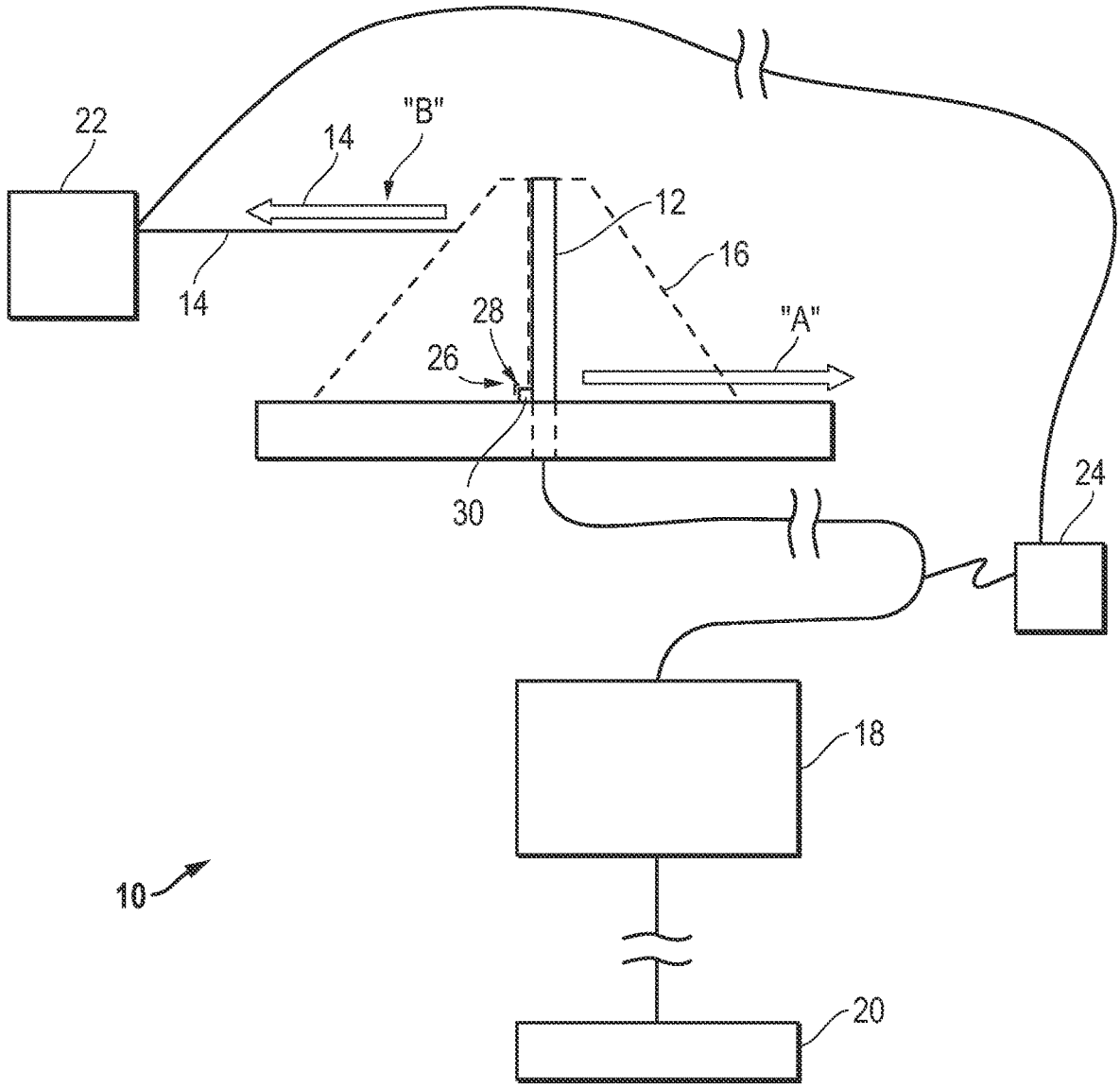
22
"B"
14
12
16
14
28
"A"
26
30
24
18
10
20

INDEPENDENT THREAD TENSION APPARATUS AND METHOD

CROSS REFERENCE TO RELATED APPLICATION

This application claims the benefit of previously filed U.S. provisional patent application No. 63/307,667 filed Feb. 8, 2022 for an "Independent Digital Thread Tension Apparatus and Method". The Applicant hereby claims the benefit of this provisional application under 35 U.S.C. § 119. The entire content of this provisional application is incorporated herein by this reference.

FIELD OF THE INVENTION

This invention relates to an independent thread tension apparatus and method. In particular, in accordance with one embodiment, the invention relates to an independent thread tension apparatus consisting of a thread support where the thread support releasably retains thread. A motor is connected with the thread support and a controller is connected with the motor such that the controller operates to move the thread support in a first direction as thread is pulled off the thread support in a second direction opposite to the first direction such that a selected tension is added to the thread.

BACKGROUND OF THE INVENTION

A problem exists with regard to the use of thread with sewing machines in that in order for the stitches to be acceptable, thread must be held in tension during the sewing process. The prior art is replete with mechanical devices using springs and the like to release thread from a thread spool under tension but, among other things, they are not adjustable, easily at least, and can not account for tension variances as more and more thread is removed from the thread spool.

Further, there is a need for a rapid detection of any breaking of the thread so as to stop the sewing process as early as possible.

Thus, there is a need in the art for a thread tension device that is, first of all, independent such that it is attachable to, and capable of use with, a variety of sewing machines and that is easily adjustable so as to ensure that a desired effective tension is always applied to thread as it leaves the thread support. Additionally, there is a need for a thread break detection system to detect thread breakage as soon as a thread breaks.

It therefore is an object of this invention to provide an improved stand alone, independent, removably attachable adjustable thread tension device that is connectable with a variety of machines, that is adjustable such that desired thread tension is provided and maintained as thread is removed and that is easy to use and economical in construction. Further, it is an object to provide an improved thread break detection system to detect breakage as soon as a thread breaks.

SUMMARY OF THE INVENTION

Accordingly, the independent thread tension apparatus and method of the present invention, according to one embodiment, includes a thread support where the thread support releasably retains thread. A motor is connected with the thread support and a controller is connected with the motor such that the controller operates to move the thread support in a first direction as thread is pulled off the thread support in a second direction opposite to the first direction such that a selected tension is added to the thread.

All terms used herein are given their common meaning as easily understood with reference to the FIGURES described herein and the description that follows. For example, a motor "controller" is a device or group of devices that can coordinate in a predetermined manner the performance of an electric motor. A motor controller might include a manual or automatic means for starting and stopping the motor, selecting forward or reverse rotation, selecting and regulating the speed, regulating or limiting the torque, and protecting against overloads and electrical faults. Motor controllers may use electromechanical switching, or may use power electronics devices to regulate the speed and direction of a motor.

In one aspect the controller is a "digital device" displaying a tension readout in numerical digits rather than by a pointer or hands on a dial.

In one aspect, the thread is connected with a sewing machine such that operation of the sewing machine pulls thread from the thread support.

In one aspect, the thread support is removably attached to a sewing machine.

In another aspect, a thread spool is provided where the thread spool is configured to hold thread and where the thread spool is configured to releasably connect with the thread support. And where the controller is connected with the motor such that the controller operates to move the thread support in a first direction as thread is pulled off the thread spool in a second direction opposite to the first direction such that a selected tension is added to the thread.

In one aspect, the thread spool and thread support include a rotation resistance device such that, when connected, thread spool rotation in one direction as thread is removed is resisted by connection of the resistance device with the thread support.

In another aspect, the rotation resistance device includes a thread spool slot and a thread support peg where the thread support peg is configured to connect with the thread spool slot such that the thread spool is held in place on the thread support.

In one aspect, the thread is connected with a sewing machine such that operation of the sewing machine pulls thread from the thread spool.

In another aspect, the thread support is removably attached to a sewing machine.

In one aspect, the apparatus includes a thread break detector connected with the sewing machine and configured to stop the operation of the sewing machine upon detection of thread breaking.

According to another embodiment, an independent thread tension apparatus consists of a thread support connected with a sewing machine; a thread spool where the thread spool is configured to hold thread and where the thread spool is configured to releasably connect with the thread support; a motor connected with the thread support; a controller connected with the motor such that the controller operates to move the thread support in a first direction as thread is pulled off the thread spool in a second direction opposite to the first direction, such that a selected tension is added to the thread; and a thread break detector connected with the sewing machine configured to stop the operation of the sewing machine upon detection of thread breaking.

In one aspect, the thread break detector is connected with the motor, the thread break detector configured to stop the operation of the sewing machine upon detection of motor misfunction.

In one aspect, the controller is a digital device.

In one aspect, the thread spool and thread support include a rotation resistance device such that, when connected, thread spool rotation in one direction as thread is removed is resisted by connection of the resistance device with the thread support.

In another aspect, the rotation resistance device includes a thread spool slot and a thread support peg where the thread support peg is configured to connect with the thread spool slot such that the thread spool is held in place on the thread support.

According to another embodiment, an independent thread tension method consists of:

a. providing a thread support where the thread support releasably retains a thread spool where the thread spool holds thread; a motor connected with the thread support and a controller connected with the motor such that the controller operates to move the thread support in a first direction as thread is pulled off the thread spool in a second direction opposite to the first direction such that a selected tension is added to the thread; and b. connecting the thread to a sewing machine.

In another aspect, the thread support is removably attached to a sewing machine.

One aspect further includes a thread break detector connected with the sewing machine and configured to stop the operation of the sewing machine upon detection of the thread breaking. In another aspect, the thread break detector is also connected with the motor, the thread break detector configured to stop the operation of the sewing machine upon detection of motor misfunction.

In one aspect, the thread spool and thread support include a rotation resistance device such that, when connected, thread spool rotation in one direction as thread is removed is resisted by connection of the resistance device with the thread support.

In another aspect, the rotation resistance device includes a thread spool slot and a thread support peg where the thread support peg is configured to connect with the thread spool slot such that the thread spool is held in place on the thread support.

DESCRIPTION OF THE DRAWING

Other objects, features and advantages of the present invention will become more fully apparent from the following detailed description of the preferred embodiment, the appended claims and the accompanying drawing in which:

FIG. 1 is a schematic view of the independent thread tension apparatus of the present invention.

DETAILED DESCRIPTION OF THE INVENTION

Before explaining at least one embodiment of the invention in detail, it is to be understood that the invention is not limited in its application to the details of construction and to the arrangements of the components set forth in the following description or illustrated in the drawing. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

The preferred embodiment of the present invention is illustrated by way of example in FIG. 1. With reference to FIG. 1, independent thread tension apparatus 10 consists of a thread support 12 where the thread support 12 releasably retains thread 14. Thread 14 is typically loaded on a thread spool 16 (shown in dotted lines) where thread spool 16 is removably attached to thread support 12. This allows for the replacement of thread 14 as desired. However, certainly, as stated, thread 14 may be loaded directly on thread support 12 when and as desired.

By "releasably attached, thread spool 16 is seen to be configured to be temporarily connected with the thread support 12. Thread spool 16 is connected with thread support 12, such that resistance to rotation may be applied as needed to the thread spool 16 so as maintain a particular thread tension. In the instance where thread 14 is located directly on thread support 12, in operation thread 14 being pulled off of thread support 12 will tend to rotate thread support 12 in one direction. Thread support 12, according to the present invention, by means of controller 20 and motor 18, is rotated in the opposite direction enough to add a selected tension to the thread 14. In sum, both the thread support 12 and, when present, thread spool 16 will rotate in the direction of thread 14 removal with the thread support 12 adding resistance to that rotation direction as thread 14 is removed so as to add tension to thread 14.

In many cases, where thread spool 16 is used, the weight of thread spool 16 and the friction of the contact with thread support 12 is enough to enable sufficient tension to be added to the thread 14 with the thread spool 16 rotating in one direction as thread 14 is removed with thread support 12 rotating against the thread spool 16 so as to add tension to the thread 14.

In some cases, the resistance to rotation may be amplified by means of a rotation resistance device 26, such as a thread spool connection slot 28 in combination with a thread support peg 30, such that while thread spool 16 can be placed on to, and lifted off of, thread support 12, once in place, thread spool 16 rotation in the direction of thread 14 removal is resisted by movement of thread support 12 in the counter direction. Again, in operation thread spool 16 is allowed to rotate in one direction as thread 14 is removed. Thread support 12 also rotates in the same direction while at the same time being controlled to rotate in the opposite direction so as to add a desired tension to the thread 14 as will be described more fully hereafter. Certainly, any other rotation resistance device now known or hereafter developed is included in the in the scope of the invention.

By way of further description, a motor 18 is connected with the thread support 12 so that operation of the motor 18 causes thread support 12 to rotate in one direction or another as desired. A controller 20 is connected with the motor 18 such that the controller 20 operates the motor 18 so as to move, that is, rotate, the thread support 12 in a first direction, see arrow "A", as thread 14 is pulled off the thread support 12 in a second direction, see arrow "B", opposite to the first direction, such that a selected tension is added to the thread 14. As is clear to those of skill in the art, in combination motor 18 and controller 20 enable complete and infinite control of the tension applied to the thread 14. Further, the controller 20 of the present invention is configured to enable a selected tension to be "set" and maintained throughout the sewing event no matter how much thread 14 remains on the thread support 12 and/or thread spool 16. In a preferred embodiment, controller 20 is a digital controller.

In one aspect, the thread 14 is connected with a sewing machine 22 such that operation of the sewing machine 22 pulls thread 14 from the thread support 12. As is expected, in a preferred embodiment, the thread support 12 is not only connected with but removably attached directly to a sewing machine 22. As may be understood, the present invention is easily used with pre-existing sewing machines 22 as an add on, after market accessory. The addition of the present invention, obviates the need to use built in, cumbersome, prior art thread tension systems and provides enhanced thread control abilities incapable of achievement by the old systems.

In one aspect, the present invention further includes a thread break detector 24 connected with sewing machine 22 and configured to instantaneously stop the operation of the sewing machine 22 upon the occurrence of thread 14 breaking. Preferably, thread break detector 24 is connected with motor 18. When thread 14 breaks, as often occurs, the ohms on motor 18 will rapidly increase, for example, indicating a motor misfunction or anomaly. Thread break detector 24, in this instance, is configured to detect the misfunction, the increase in ohms, and operates to stop sewing machine 22. This stops the uncontrolled unraveling of thread well before the normal process dependent on human observation and allows a user to re-thread the sewing machine 22 and start sewing after only backing up one or two stitches instead of the hundreds stitches typical of prior art systems. Certainly, other thread break detector 24 systems, such as optical, may be used as well.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An independent thread tension apparatus comprising:

a. a thread support wherein the thread support releasably retains thread and wherein the thread support is removably attached to a sewing machine;

b. a motor connected with the thread support; and c. a controller connected with the motor such that the controller operates to move the thread support in a first direction as thread is pulled off the thread support in a second direction opposite to said first direction such that a selected tension is added to the thread.

2. The apparatus of claim 1, wherein the controller is a digital device.

3. The apparatus of claim 1 wherein the thread is connected with a sewing machine such that operation of the sewing machine pulls thread from the thread support.

4. The apparatus of claim 1 further including:

a. a thread spool wherein the thread spool is configured to hold thread and wherein the thread spool is configured to releasably connect with said thread support; and b. wherein the controller is connected with the motor such that the controller operates to move the thread support in a first direction as thread is pulled off the thread spool in a second direction opposite to said first direction such that a selected tension is added to the thread.

5. The apparatus of claim 4 wherein the thread spool and thread support include a rotation resistance device such that, when connected, thread spool rotation in one direction as thread is removed is resisted by connection of said rotation resistance device with the thread support.

6. The apparatus of claim 5 wherein the rotation resistance device includes a thread spool slot and a thread support peg wherein the thread support peg is configured to connect with the thread spool slot such that said thread spool is held in place on said thread support.

7. The apparatus of claim 4 wherein the thread is connected with a sewing machine such that operation of the sewing machine pulls thread from the thread spool.

8. The apparatus of claim 4 wherein the thread support is removably attached to a sewing machine.

9. The apparatus of claim 3 further including a thread break detector connected with the sewing machine and configured to stop the operation of the sewing machine upon detection of thread breaking.

10. The apparatus of claim 9 wherein the thread break detector is connected with the motor, the thread break detector configured to stop the operation of the sewing machine upon detection of motor misfunction.

11. An independent thread tension apparatus comprising:

a. a thread support connected with a swing machine;

b. a dread spool wherein the thread spool is configured to hold thread and wherein the thread spool is configured to releasably connect with said dread support;

c. a motor connected with the thread support;

d. a controller connected with the motor such that the controller operates to move the thread support in a first direction as thread is pulled off the thread spool in a second direction opposite to said first direction, such that a selected tension is added to the thread; and c. a thread break detector connected with the sewing machine and configured to stop the operation of the sewing machine upon detection of thread breaking.

12. The apparatus of claim 11 wherein the thread break detector is connected with the motor, the thread break detector configured to stop the operation of the sewing machine upon detection of motor misfunction.

13. The apparatus of claim 11, wherein the controller is a digital device.

14. The apparatus of claim 11 wherein the thread spool and thread support include a rotation resistance device such that when connected thread spool rotation in one direction as thread is removed is resisted by connection of said resistance device with the thread support.

15. The apparatus of claim 14 wherein the rotation resistance device includes a thread spool slot and a thread support peg wherein the thread support peg is configured to connect with the thread spool slot such that said thread spool is held in place on said thread support.

16. An independent thread tension method consisting of:

a. providing a thread support wherein the thread support releasably retains a thread spool wherein said thread spool holds thread; a motor connected with the thread support and a controller connected with the motor such that the controller operates to move the thread support in a first direction as thread is pulled off the thread spool in a second direction opposite to said first direction such that a selected tension is added to the thread and a thread break detector connected with the sewing machine and configured to stop the operation of the sewing machine upon detection of the thread breaking; and b. connecting said thread to a sewing machine.

17. The method of claim 16 wherein the thread break detector is connected with the tor, the thread break detector configured to stop the operation of the sewing machine upon detection or motor misfunction.

18. The method of claim 16 wherein the thread spool and thread support include a rotation resistance device such that when connected thread spool rotation in one direction as thread is removed is resisted by connection of said resistance device with the thread support.

19. An independent thread tension apparatus comprising:

a. a thread support wherein the thread support releasably retains thread;

b. a motor connected with the thread support;

c. a controller connected with the motor such that the controller operates to move the thread support in a first direction as thread is pulled off the thread support in a second direction opposite to said first direction such that a selected tension is added to the thread;

d. a thread spool wherein the thread spool is configured to hold thread and wherein the thread spool is configured to releasably connect with said thread support;

e. wherein the thread pool and thread support include a rotation resistance device such that, when connected, thread spool rotation in one direction as thread is removed is resisted by connection of said resistance device with the thread support; and f. wherein the rotation resistance device includes a thread spool slot and a thread support peg wherein the thread support peg is configured to connect with the thread spool slot such that said thread spool is held in place on said thread support.

20. An independent thread tension apparatus comprising:

a. a thread support wherein the thread support releasably retains thread;

b. a motor connected with the thread support; and c. a controller connected with the motor such that the controller operates to move the thread support in a first direction as thread is pulled off the thread support in a second direction opposite to said first direction such that a selected tension is added to the thread;

d. wherein the thread is connected with a sewing machine such that operation of the sewing machine pulls thread from the thread support; and e. a thread break detector connected with the sewing machine and configured to stop the operation of the sewing machine upon detection of thread breaking wherein the thread break detector is connected with the motor, the thread break detector configured to stop the operation of the sewing machine upon detection of motor misfunction.

* * * * *